US006664225B2

(12) United States Patent
Mumoli

(10) Patent No.: US 6,664,225 B2
(45) Date of Patent: Dec. 16, 2003

(54) SINGLE-DOSE QUICK-DISSOLVING CLEANSING AGENT WITH MEDICINAL PROPERTIES

(76) Inventor: Jose Alejandro Mumoli, Hogo Zeyen 6234, Dto. 13, 1684 C.J, El Palomar, Buonos Aires (AR)

( * ) Notice: Subject to any disclaimer, the term of this patent is extended or adjusted under 35 U.S.C. 154(b) by 0 days.

(21) Appl. No.: 10/340,501

(22) Filed: Jan. 10, 2003

(65) Prior Publication Data

US 2003/0153482 A1 Aug. 14, 2003

Related U.S. Application Data

(63) Continuation-in-part of application No. 09/725,975, filed on Nov. 29, 2000, now Pat. No. 6,541,441.

(30) Foreign Application Priority Data

Dec. 1, 1999 (AR) ..... P 99 01 06115

(51) Int. Cl.[7] ..... C11D 17/00

(52) U.S. Cl. ..... 510/446; 510/141; 510/444; 510/445; 510/447; 510/290; 510/298

(58) Field of Search ..... 510/446, 141, 510/444, 445, 447, 290, 298

(56) References Cited

U.S. PATENT DOCUMENTS 5,529,788 A * 6/1996 DeSenna ..... 424/466
5,817,337 A * 10/1998 DeSenna ..... 424/466

* cited by examiner

*Primary Examiner*—Charles Boyer
(74) *Attorney, Agent, or Firm*—Merchant & Gould P.C.

(57) ABSTRACT

A single-dose quick dissolving cleansing agent, also with preventing and treating activity for disorders and diseases in human beings and animals, wherein the agent comprises a surfactant, a first and second disintegrating agents combined for causing a sudden disintegration and dissolution of the agent upon contacting the agent with a liquid medium, an agglutinating agent, a phyto-therapeutic extract providing the preventing and treating activity, and bactericide, essences and colorants.

13 Claims, No Drawings

SINGLE-DOSE QUICK-DISSOLVING CLEANSING AGENT WITH MEDICINAL PROPERTIES

BACKGROUND OF THE INVENTION

1. Field of the Invention

The present invention relates to the field of cleansing agents, preferably for personal use and, more particularly the invention refers to a single-dose cleansing unit, for prevention and treatment of several disorders and diseases and for personal hygiene such as a toilet soap, a soap bar, shampoo, hair conditioner, hair rinsing agents, capillary tonics, bath gels, and tooth paste as well any other cleaning and cleansing product for personal and domestic application, wherein the product also comprises phyto-therapeutic extracts.

Such extracts are employed in the treatment of a variety of disorders like acne and skin diseases, as well as for seborrhea and damaged dry-hair.

For the purpose of this disclosure the term "single-dose" generically means that the cleansing unit, product or agent of the invention is designed for use only once by the user, such as an individual or animal, without remaining disposing portions of the unit except that the user decides to leave portions of the unit without using the entirety of same.

2. Description of the Prior Art

For a several number of years many formats and shapes have been used for various kinds of cleaning and cleansing agents used for personal applications and other uses in the domestic and industrial areas. The formats and presentation of these products have always been the results of studies related to the particular use of the agent, that is, in liquid, powder and solid formulations.

For example, in the particular case of toilet soap bars, the same have been commercialized in larger or smaller pieces of soap, but always such units had a size enough to use the soap bar for several times. While all these soap bars have been designed for personal use, these bars are exposed to the use by many different persons either in the house, or in worse conditions, in public locations, such as toilets or bathrooms at restaurants, gas stations, etc. It is quite common to find a soap bar of this type with many impurities like dirty, down, hair and other undesired elements. While the bar is found in solid state, dry and with consistency enough to be used, people is reluctant to use the soap bar in the above dirty conditions and, generally, the soap bar is disposed even with an almost entire original size, that is with a little use. In other words, the soap is wasted prematurely because of its appearance.

Other cleansing products such as shampoos and hair conditioners are commercialized in large and non practical containers which, in addition to the inconveniences of these containers in their use, the same are spoilage and dangerous agents for the environment when empty. Sometimes, the cost of the container reaches the cost of the contained product and, even if special caps are fitted in the container, few possibilities of metering the content are provided for the consumer. Generally, when used by children or in baths at sport clubs, hotels and other public places, the product is remarkably wasted such as poured onto the floor, used unnecessarily in excess, etc.

The above problems and drawbacks are exasperated when the cleansing product is a medicated product with medicinal components for the treatment of a disorder or diseases that causes the product to be only for personal use.

In view of the above drawbacks, it would therefore be convenient to have a kind of soap, shampoo, hair conditioner or any other cleaning product, preferably a personal toilet product, capable of providing a personal unit with a small size, to be used once and disposed without waste of the product. Even if a person skilled in the art would think that this question is easily resolved by making a soap bar or cleansing product as small as possible to only cover the needs of an individual for washing hands or taking a bath or a shower, this attempt has not been shown as a solution to this problem as long as too much time must be awaited until such presumable soap bar is dissolved in the hands, over the human body or in any other application.

It would be therefore desirable to find such a small cleaning agent product unit capable of being applied, preferably, in personal hygiene and having a high capacity to be quickly dissolved in a washing or cleansing operation.

It would also be desirable that the product be a single-dose cleansing product comprising agents or components for treating the skin, the head skin and/or hair, with the agents being phyto-therapeutic extracts with several medicinal, healing, curing and repairing activities, for example.

3. Summary of the Invention

It is therefore an object of the present invention to provide a single-dose quick dissolving cleansing agent, with preventing and treating activity for the treatment of disorders and diseases in human beings and animals, wherein the agent comprises a surfactant, a first and second disintegrating agents combined for causing a sudden disintegration and dissolution of the agent upon contacting the agent with a liquid medium, an agglutinating agent, a phyto-therapeutic extract providing the preventing and treating activity, and bactericide, essences and colorants.

It is also an object of the present invention to provide a single-dose, quick dissolving, cleansing, preventing and treating agent for use in individuals and animals, wherein the agent comprises the following components: about 10 wt % to about 30 wt % of a surfactant; about 5 wt % to about 15 wt % of a first disintegrating agent; about 10 wt % to about 60 wt % of a second disintegrating agent, wherein the first and second disintegrating agents causing a sudden disintegration and dissolution of the agent upon contacting the agent with a liquid medium; about 5 wt % to about 20 wt % of an agglutinating agent; about 3 wt % to about 20 wt % of a phyto-therapeutic extract; and bactericide, essences and colorants.

It is still another object of the present invention to provide a single-dose, quick dissolving, cleansing, preventing and treating agent for use in individuals and animals, wherein the agent comprises the following components: a surfactant selected from the group comprising lauryl sodium sulfate, Sodium Meyhil Oleyl Taurate (Hostapon), Sodium cocoylisthionates (SCI), purified coconut oil derivatives, Sodium Lauryl Sulfosuccinate, cocamidopropylbetaine and mixtures thereof; a first disintegrating agent selected from the group comprising croscaramellose, sodic croscaramellose (Acdisol, starch 1500 pvp-xl, explotab), polyvinyl pyrrolidone, carboxymethyl cellulose; a second disintegrating agent, such as micro-crystalline cellulose (Avicel), an agglutinating agent selected from the group comprising gum arabic, cellactose and hydrolyzed lactose, a phyto-therapeutic extract selected from the group comprising extracts of *Betula alba, Aloe feroxmill, Achilea millefollum, Árnica montana, Calendula officinalis, Fucus vesiculosus, Humulus lupulus, Melissa officinalis, Urtica dioica, Ros marinus officinalis, Ruscus aculeatus, Rosa Aff. rubiginosa,*

*Salvia officinalis, Sambucus nigra, Vitis vinifera, Tilia platythyllos, Santalum albuml, Panax ginseng, Centella asiática, Melilotus chamomilla, Matricaria recutita, Malva sylvestris, Hedera helix, Lawsonia inermis, Hammelis virginiana,* Quina, *Sylibum marianum,* Crataegus, algae, Geranium and combinations thereof.

It is even another object of the present invention to provide the above disclosed agent further comprising co-surfactant components, adjuvant agents, antistatic agents, fragrances, dies, opacity agents and/or a wetting adjuvant agent selected from the group comprising vegetal amides, cold cream, lanoline, silicone and its derivatives.

It is even another object of the present invention to provide the above disclosed agent comprising a bactericide selected from the group comprising Bactekrill, Triclosan, Nipagin, Nipasol and combinations thereof.

It is still another object of the present invention to provide the above disclosed agent with the components being compressed from a powder form and agglutinated into a compact and quick soluble solid agent, unit or product defining a body selected from the group comprising a solid bar, a solid tablet, a solid pill, solid pellets, solid lozenges, capsules, and an ovule with a wet interior and an outer gel cover, all being for only one personal use.

It is still another object of the present invention to provide a single-dose, quick dissolving, cleansing, preventing and treating agent, unit or product for use in individuals and animals, wherein the agent has a pH between 5 and 8 and a weight between 0.3 and 5 g.

The above and other objects, features and advantages of this invention will be better understood when taken in connection with the following description and preferred embodiments.

DESCRIPTION OF THE PREFERRED EMBODIMENTS

The inventive cleansing agent, also named product or unit, for use in preventing and treating several disorders and diseases, preferably in the skin and hair, is a basic formulation comprising a surfactant, a first disintegrating agent, such as croscaramellose; a second disintegrating agent, such as micro-crystalline cellulose, an agglutinating agent such as cellactose; and bactericides, essences and colorants. According to the invention, a specific phyto-therapeutic extract is added to the above formulation with the desired purposes of prevention and treatment. A person skilled in the art will be able to find a variety of phyto-therapeutic extracts within the scope and spirit of the invention.

Depending on the case, an elaboration method should be adjusted to the characteristics of the employed extract, for thus obtaining the cleansing, preventing and treating agent of the invention preferably in a form of a compressed tablet. Thus, the size of the particles or granules of some or all of the components, the compression values and other parameters forming part of the process may be adjusted.

In some embodiments, due to the characteristics of the product, the pH may be adjusted. For example, for hair rinsing products the pH is adjusted to a value between 5 and 6.

Said adjustment may be carried out by adding organic acids, in powder form, in an amount between about 0.3 to about 1 wt %. The organic acids may be citric acid, tartaric acid, or other acids well known in the art.

The inventive cleansing agent may be commercialized in the form of solid bar, a solid tablet, a solid pill, solid pellets, solid lozenges, capsules, ovules with a wet interior and an outer gel cover, etc., and preferably in tablet form having a weight of about 1.5 g.

The invention may be obtained through a process by compressing all of the dry powdered components, having a humidity degree <0.2%, for example, adjusting the granulometry by milling and sifting or screening, and maintaining a humidity of 35% to 55% in the working room.

Some phyto-therapeutic extracts may be found in the market in liquid or oily form, therefore, the process may require an intermediate step, humid granulating process, consisting of mixing all the components of the cleansing agent together with the extract and diluting said mixture in the solvent of the extract until obtaining a humid or wet mass that is dried at a temperature enough for preventing the components from being altered. At a temperature of 70° C., for example. Once the mixture is at a 0.2% humidity, the same is milled and compacted or compressed until obtaining a solid tablet, for example. It is also possible to transform the humid mass into solid tablets that, afterwards, are milled and sifted to convert the same into a dry powder to be finally compacted.

In certain embodiments the first disintegrating agent, sodium croscaramellose, for example, is incorporated in steps, adding a part of same during the humid granulation process and adding the remaining part of same into the final powder mixture, all this before the compacting or compression step. This two-part process improves and enhances the dissolution, and takes advantage of the absorption and swelling properties, of the sodium croscaramellose. The addition of sodium croscaramellose during the step of humid granulation provides an intimate mixture between the several components and such addition, during the final dry mixing, allows the same to be distributed intra and extra granularly, thus optimizing its function as disintegrating agent.

The extracts may be hydro-glycolic, hydro-alcoholic, oily extracts, or soft extracts. For each particular case, the extract should be diluted in the corresponding solvent. For example, in glycol, alcohol, oil and water.

The phyto-therapeutic product may be anyone known in the art, such as the extracts from *Betula alba, Aloe feroxmill, Achilea millefollum, Árnica montana, Calendula officinalis, Fucus vesiculosus, Humulus lupulus, Melissa officinalis, Urtica dioica, Ros marinus officinalis, Rosa Aff. rubiginosa, Salvia officinalis, Sambucus nigra, Vitis vinifera* or combinations thereof.

The cleansing and treating product of the invention may also comprise proteins, such as hydrolyzed collagens, vitamins, oligoelements, anti-oxidants and bio-molecule protectors.

The phyto-therapeutic extracts are employed in medicine and cosmetic with tested efficiency. Their therapeutic effects are due to the active principles contained in the same. For example, the extract of *Betuna alba* is used as an stimulant, astringent and antiseptic. The extract of Sambucus nigra is used as anti-rosaceous, anti-itching and skin softener, and the extract of *Vitis vinifera* is used as vasoconstrictor and astringent tonic.

As a way of example, and without restricting the scope of the invention, a variety of formulations for the inventive cleansing, preventing and treating agent are as follows.

EXAMPLES

1. Formulation for an anti-seborrhea shampoo:

| | |
|---|---|
| SODIUM LAURYL SULFATE | 20–25% p/p |
| MICROCRYSTALLINE CELLULOSE | 10–15% p/p |
| SODIUM CROSCARAMELLOSE | 5–10% p/p |
| CELLACTOSE | 10–15% p/p |
| PERFUME ESSENCE | 0.3–0.5% p/p |
| COLORANT | 0.3–0.5% p/p |
| CINCHONA BARK COMPLEX | 50–60% p/p |

2. Formulation for a cutis cleansing agent with anti-acne activity:

| | |
|---|---|
| SODIUM COCOYLISETHIONATE | 20–25% p/p |
| MICROCRYSTALLINE CELLULOSE | 40–60% p/p |
| SODIUM CROSCARANELLOSE | 5–10% p/p |
| CELLACTOSE | 10–15% p/p |
| CRATAEGUS | 0.5–2% p/p |
| *Ros marinus officinalis* | 0.5–2% p/p |
| *Hamamelis virginiana* | 0.5–3% p/p |
| *Arnica montana* | 0.5–5% p/p |
| *Salvia officinalis* | 0.5–5% p/p |
| *Melissa officinalis* | 0.5–5% p/p |
| FRAGANCE | 0.5–2% p/p |

3. Formulation for a capillary tonic:

| | |
|---|---|
| HOSTAPON | 10–15% p/p |
| LAURYL SULFATE | 10–15% p/p |
| SODIUM CROSCARAMELLOSE | 5–10% p/p |
| CELLACTOSE | 10–15% p/p |
| *Urtica dioica* | 1–5% p/p |
| HENNA | 1–5% p/p |
| *Humulus lupulus* | 1–5% p/p |
| *Arnica montana* | 1–5% p/p |
| COLORANT | 0.5–2% p/p |
| FRAGANCE | 0.5–3% p/p |

4. Formulation for a cleansing agent for injured skin:

| | |
|---|---|
| HOSTAPON | 10–15% p/p |
| SODIUM CROSCARAMELLOSE | 5–10% p/p |
| MICROCRYSTALLINE CELLULOSE | 40–60% p/p |
| CELLACTOSE | 10–15% p/p |
| *Rosa Aff. rubiginosa* | 3–10% p/p |
| COLORANT | 0.5–1% p/p |

5. Formulation for a cutis cleansing agent with anti-acne and healing activity:

| | |
|---|---|
| HOSTAPON | 10–20% p/p |
| MICROCRYSTALLINE CELLULOSE | 40–60% p/p |
| SODIUM CROSCARAMELLOSE | 5–10% p/p |
| CELLACTOSE | 10–15% p/p |
| *Arnica montana* | 10–15% p/p |
| PERFUM | 1–2% p/p |

6. Formulation for a hair revitalizing shampoo and bath gel:

| | |
|---|---|
| SODIUM LAURYL SULFATE | 15–25% p/p |
| MICROCRYSTALLINE CELLULOSE | 40–60% p/p |
| SODIUM CROSCARAMELLOSE | 5–10% p/p |
| CELLACTOSE | 10–15% p/p |
| CAMPHOR | 0.5–2% p/p |
| *Ros marinus officinalis* | 2–5% p/p |
| COLORANT | 0.3–1% p/p |
| PERFUM | 0.5–2% v |

7. Formulation for a facial cleansing agent with healing and antiseptic activity, specially for use after shaving:

| | |
|---|---|
| HOSTAPON | 15–25% p/p |
| MICROCRYSTALLINE CELLULOSE | 40–60% p/p |
| SODIUM CROSCARAMELLOSE | 5–10% p/p |
| CELLACTOSE | 10–15% p/p |
| *Calendula officinalis* | 3–5% p/p |
| COLORANT | 0.2–1% p/p |
| PERFUM | 0.3–1% p/p |

8. Formulation for a shampoo for fatty hair:

| | |
|---|---|
| HOSTAPON | 15–25% p/p |
| MICROCRYSTALLINE CELLULOSE | 40–60% p/p |
| SODIUM CROSCARAMELLOSE | 5–10% p/p |
| CELLACTOSE | 10–15% p/p |
| *Ros marinus officinalis* | 0.5–3% p/p |
| *Salvia officinalis* | 0.5–3% p/p |
| COLORANT | 0.2–1% p/p |
| PERFUM | 0.3–1% p/p |

9. Formulation for a shampoo for dry and damaged hair:

| | |
|---|---|
| LAURYL SULFATE | 15–25% p/p |
| MICROCRYSTALLINE CELLULOSE | 40–60% p/p |
| SODIUM CROSCARAMELLOSE | 5–10% p/p |
| CELLACTOSE | 10–15% p/p |
| GERANIUM | 1–3% p/p |
| *Santalum albuml* | 3–5% p/p |
| YLANG-YLANG | 1–3% p/p |
| COLORANT AND PERFUM | 0.5–2% p/p |

10. Formulation for a toothpaste in individual doses:

| | |
|---|---|
| LAURYL SULFATE | 15–25% p/p |
| SODIUM CROSCARAMELLOSE | 5–10% p/p |
| MICROCRYSTALLINE CELLULOSE | 40–60% p/p |
| CELLACTOSE | 10–15% p/p |
| MINT ESSENCE | 3–5% p/p |
| HORTELA ESSENCE | 1–3% p/p |
| SODIUM FLUORIDE | 0.5–3% p/p |
| TRICLOSAN | 0.5–2% p/p |

11. Formulation for a healing toothpaste for treating oral ulcer:

| | |
|---|---|
| LAURYL SULFATE | 15–25% p/p |
| SODIUM CROSCARAMELLOSE | 5–10% p/p |
| MICROCRYSTALLINE CELLULOSE | 40–60% p/p |
| CELLACTOSE | 10–15% p/p |
| MINT ESSENCE | 3–5% p/p |
| *Fucus vesiculosus* | 3–5% p/p |

12. Formulation of a cleansing agent for treating feet lesions:

| | |
|---|---|
| LAURYL SULFATE | 15–25% p/p |
| SODIUM CROSCARAMELLOSE | 5–10% p/p |
| MICROCRYSTALLINE CELLULOSE | 40–60% p/p |
| CELLACTOSE | 10–15% p/p |
| *Salvia officinalis* | 3–10% p/p |
| BACTEKRILL | 0.3–1% p/p |
| COLORANT | 0.3–1% p/p |
| PERFUM | 0.3–1% p/p |

13. Formulation for a cream cleansing agent for treating cellulitis:

| | |
|---|---|
| LAURYL SULFATE | 20–25% p/p |
| SODIUM CROSCAPAMELLOSE | 5–10% p/p |
| MICROCRYSTALLINE CELLULOSE | 10–15% p/p |
| CELLACTOSE | 10–15% p/p |
| *Ruscus aculeatus* | 5–10% p/p |
| *Vitis vinifera* | 1–3% p/p |
| COLORANT | 0.3–0.8% p/p |
| PERFUM | 0.5–1% p/p |

All the components of formulation 13 are commercialized in form of dry powder, therefore, the process for obtaining the formulation requires of mixing said components and afterwards directly compacting the same until obtaining a cleansing tablet. The inventive cleaning or cleansing agent is suddenly disintegrated or dispersed upon a minimum washing action in a liquid medium.

The proportions and components may be adjusted to manufacture a cleaning agent unit such as a solid bar, a solid tablet, a solid pill, solid pellets, solid lozenges and capsules, as well as any other unit with a desired form, shape and size according to the particular application of the agent. Alternatively, a desired formulation form comprises an ovule having a wet interior and an outer gel cover.

The ways for obtaining the inventive agent will be better understood by means of the following examples which are not restrictive of the scope of the invention, which scope is defined in the appended claims.

Example 1

Dry elaboration by direct compression of an antiseptic cleansing agent for sanitary use.

The elaboration of the inventive cleansing agent is carried out into an area comprising a drying, granulating, milling and sifting section that is conditioned with over pressurized air, at a temperature between 22 and 25° C. and a room humidity of 40% to 55%; a bulk mixing section under the same above conditions and a compression section with over pressurized air, temperature of 18–25° C. and room humidity of 40% to 55%.

Preparation of 150 kg of the cleansing agent: in the mixing and sifting section, a pre-mixing is carried out for 15 minutes with 2.3 kg of bactericide, 19.5 kg of cellactose and 19 kg (50% of the total quantity) of sodium lauryl sulfate. Afterwards, the mixture is sifted in an oscillating sift mesh N° 30 for approximately 12 minutes. Additionally, the remaining 50% of the sodium lauryl sulfate (19 kg) is sifted in a mesh N° 30 for 7–8 minutes. Finally all powders are added together with 9 kg of ACDISOL and 82 kg of AVICEL in a two-cone mixer and mixed for 25 minutes. The product is discharged through a valve into containers (BINES) with plastic bags of 25 kg each. Under a controlled atmosphere, the mixed product is carried to the compression section and it is discharged into a hopper regulating, when the operation begins, the fluidity, the leveling or grading, the pressure (1.2–1.8 Kp) and weight (450 mg). The pressure is controlled with a hardness meter and a control of friability is carried out, both controls every 30 minutes during compression. The weight is controlled with a digital scale.

The obtained tablets or pills are packaged in bines with plastic bags that, after the quality control, are transferred to the packaging section wherein the same are placed in aluminum/PVC blisters containing 10 units, thus obtaining about 306.000 pills, with a loss of about 10%.

Each tablet, obtained as disclosed above, comprises:

| | |
|---|---|
| Sodium Lauryl sulfate | 25% p/p |
| Sodium Croscaramellose (ACDISOL) | 6% p/p |
| Cellactose | 13% p/p |
| Microcrystalline Cellulose (AVICEL PH101) | 54.5% p/p |
| Bactericide-germicide (Triclosan) | 1.5% p/p |

Example 2

Elaboration by wet granulation of a formulation for a cutis cleansing agent with healing and anti-acne activity (Formulation 5):

The working conditions at the working areas are the same of Example 1. The process has employed a stainless steel screw kneader, an indirect steam drying furnace, a hammer mill, an oscillating sifter, a drum mixer for pre-mixing, a double mixer for final mixing, bines, a 36-mandril press and a machine for filling in blisters.

Preparation of 100 kg. of Final Product

In a pan, 16.2 kg. of Arnica hydro alcoholic montana, 3.2 kg of ACDISOL, 20 kg of Avicel PH 101 and 20 liters of a solution of water/ethylic alcohol (60/40) have been slowly added with the kneading speed being increased up to a maximum of 10 r.p.m. at a 10-minute time from the beginning of the operation, the mixture was kneaded for 30 minutes. The mass is removed and spread over trays in a drying furnace at 70° C., for 6 hours. After 5 hours, samples are taken every 30 minutes and the humidity percentage is determined until the mass reaches a 0.2% humidity.

The big and pasty granules obtained in the above step are milled in a hammer mill for 15 minutes and then the milled product is sifted in a mesh 30 sifter. This product is poured into a drum mixer and 3.2 kg of ACDISOL (corresponding to the remaining 3%), 2 kg of powdered perfume are added and these products are mixed for 10 minutes. The obtained mixture is carried into a double-cone mixer wherein the remaining components, namely 33 kg of AVICEL and 12.2 kg of Hostapon, are added and mixed for 40 minutes. Then, this has been sifted in a mesh 30 sifter, the compression or compacting step is carried out like in example 1 and the tablets are packaged in blisters.

Each tablet comprise:

| | |
|---|---|
| Hostapon | 12% p/p |
| Microcrystalline Cellulose (Avicel PH101) | 52% p/p |
| Sodium Croscaramellose (ACDISOL) | 6% p/p |
| Cellactose | 13% p/p |
| *Arnica montana*[HA] | 15% p/p |
| Perfume | 2% p/p |

While preferred embodiments of the present invention have been illustrated and described, it will be obvious to those skilled in the art that various changes and modifications may be made therein without departing from the scope of the invention as defined in the appended claims.

I claim:

1. A single-dose, quick dissolving, cleansing, preventing and treating agent for use in individuals and animals, wherein the agent comprises the following components:

about 10 wt % to about 30 wt % of a surfactant;

about 5 wt % to about 15 wt % of a first disintegrating agent;

about 10 wt % to about 60 wt % of a second disintegrating agent, wherein the first and second disintegrating agents cause a sudden disintegration and dissolution of the agent upon contacting the agent with a liquid medium;

about 5 wt % to about 20 wt % of an agglutinating agent;

about 3 wt % to about 20 wt % of a phyto-therapeutic extract; and bactericide, essences and colorants.

2. The agent of claim 1, wherein the surfactant is selected from the group consisting of lauryl sodium sulfate, Sodium Meyhil Oleyl Taurate (Hostapon), Sodium cocoylisthionates (SCI), purified coconut oil derivatives, Sodium Lauryl Sulfosuccinate, cocamidopropylbetaine and mixtures thereof.

3. The agent of claim 1, wherein the first disintegrating agent is selected from the group consisting of croscaramellose, sodium croscaramellose, polyvinyl pyrrolidone, carboxmethyl cellulose.

4. The agent of claim 1, wherein the second disintegrating agent is selected from the group consisting of microcrystalline cellulose.

5. The agent of claim 1, wherein the agglutinating agent is selected from the group consisting of gum arabic, cellactose and lactose anhydrous.

6. The agent of claim 1, wherein the phyto-therapeutic extract is selected from the group consisting of extracts of *Betula alba, Aloe feroxmill, Achilea millefollum, Árnica Montana, Calendula officinalis, Fucus vesiculosus, Humulus lupulus, Melissa officinalis, Urtica dioica, Ros marinus officinalis, Ruscus aculeatus, Rosa Aff. rubiginosa, Salvia officinalis, Sambucus nigra, Vitis vinifera, Tilia platythyllos, Santalum albuml, Panax ginseng, Centella asiática, Melilotus chamomilla, Matricaria recutita, Malva sylvestris, Hedera helix, Lawsonia inermis, Hammelis virginiana,* Quina, *Sylibum marianum,* Crataegus, algae, Geranium and combinations thereof.

7. The agent of claim 1, further comprising co-surfactant components, adjuvant agents, antistatic agents, fragrances, dyes and opacity agents.

8. The agent of claim 1, wherein the bactericide is selected from the group consisting of Bactekrill, Triclosan, Nipagin, Nipasol and combinations thereof.

9. The agent of claim 1, wherein the components are compressed from a powder form and agglutinated into a compact and quick soluble solid agent.

10. The agent of claim 1, wherein it is a body selected from the group consisting of a solid bar, a solid tablet, a solid pill, solid pellets, solid lozenges, capsules, and an ovule with a wet interior and an outer gel cover, all being for only one personal use.

11. The agent of claim 1, further comprising a wetting adjuvant agent selected from the group consisting of vegetal amides, cold cream, lanoline, silicone and its derivatives.

12. The agent of claim 1, wherein it has a pH between 5 and 8.

13. The agent of claim 1, wherein the single-dose of the agent has a weight between 0.3 and 5 g.

* * * * *